United States Patent [19]

Monreal

[11] Patent Number: 4,648,849

[45] Date of Patent: Mar. 10, 1987

[54] KNEE BINDINGS COMPATIBLE WITH ORDINARY WATER SKIS

[76] Inventor: F. Javier Monreal, 4242 Barker Hill Rd., Jamesville, N.Y. 13078

[21] Appl. No.: 721,686

[22] Filed: Apr. 10, 1985

Related U.S. Application Data

[63] Continuation-in-part of Ser. No. 594,367, Mar. 28, 1984, abandoned, and Ser. No. 615,369, May 30, 1984, abandoned.

[51] Int. Cl.[4] ..... A63C 5/00

[52] U.S. Cl. ..... 441/70; 280/611; 280/809

[58] Field of Search ..... 280/12 A, 12 B, 809, 280/601, 12 F, 18, 12 R, 611; 2/24, 62; 441/65, 68, 70, 72

[56] References Cited

U.S. PATENT DOCUMENTS

| | | | |
|---|---|---|---|
| 3,395,411 | 8/1968 | Pope, Jr. et al. | 441/68 |
| 3,435,471 | 4/1969 | Drennen, Jr. | 441/65 |
| 3,689,092 | 9/1972 | Lake | 441/70 X |
| 3,908,198 | 9/1975 | Brock | 2/24 |
| 4,028,761 | 6/1977 | Taylor | 441/65 |
| 4,353,573 | 10/1982 | Morgan | 280/606 |

FOREIGN PATENT DOCUMENTS

| | | | |
|---|---|---|---|
| 174845 | 10/1952 | Austria | 280/607 |

*Primary Examiner*—David M. Mitchell
*Assistant Examiner*—Michael Mar

[57] ABSTRACT

A knee binding comprising a flexible and semi-rigid shell which engulfs the sides of a user's knee, lower thigh and upper calf in the kneeling position with the user kneeling upon a rubberized padded area. The device is paired and separate for each leg and is used for the purpose of water skiing when towed by a rope held by the user's hand(s). The rubberized kneeling pad may be an ordinary rubberized foot binding for a water ski. The foot binding is kept tucked under the user's leg when the ski is used in the kneeling position. The knee binding permits, without interference, the regular use of the foot binding.

3 Claims, 6 Drawing Figures

KNEE BINDINGS COMPATIBLE WITH ORDINARY WATER SKIS

BACKGROUND INFORMATION AND PURPOSE

This patent application is a continuation-in-part of the previously filed applications Ser. Nos. 06/594,367, filed Mar. 28, 1984 and 06/615,369, filed May 30, 1984, both abandoned.

This sporting device intends to make feasible not only the standard position of standing on a pair of skis while towed by a rope that is attached to a motor boat at a high speed, but also the kneeling position on the same pair of skis. This invention allows the user to stand on the skis placing his/her feet in the ordinary rubberized bindings, and, as alternate postition, to kneel on the rubberized pad already provided by the foot binding itself while being held in position by the here-proposed knee binding.

The prior art reveals: U.S. Pat No. 4,353,573 of Morgan; U.S. Pat. No. 3,689,092 of Lake; Austrian Pat No. 174,845 of Kilma; U.S. Pat. No. 3,395,441 of Pope et al.; U.S. Pat. No. 3,435,471 of Drennen; U.S. Pat. No. 3,908,198 of Brock and U.S. Pat. No. 4,028,761 of Taylor. None of them are compatible with regular "standing" skis and none offers protection of the knee joint as they only hold on to the knee itself or to the calf or they have too shallow a pocket for the knee.

BRIEF DESCRIPTION OF THE INVENTION

This sporting device consists of a hard and moderately tense elastic shell that embraces the sides of the kneeling user's knee, the lower thigh and upper calf while being open in its top and rear for entry and release, and also open in its bottom, having its bottom free edge attached to the water ski at the ouline that contours the points of attachment of the front piece of ordinary foot water ski bindings. The user's knee then rests on the rubberized foot binding that is kept tucked under the knee.

BRIEF DESSCRIPTION OF THE DRAWINGS

DETAILED DESCRIPTION OF THE INVENTION

Figure 3:
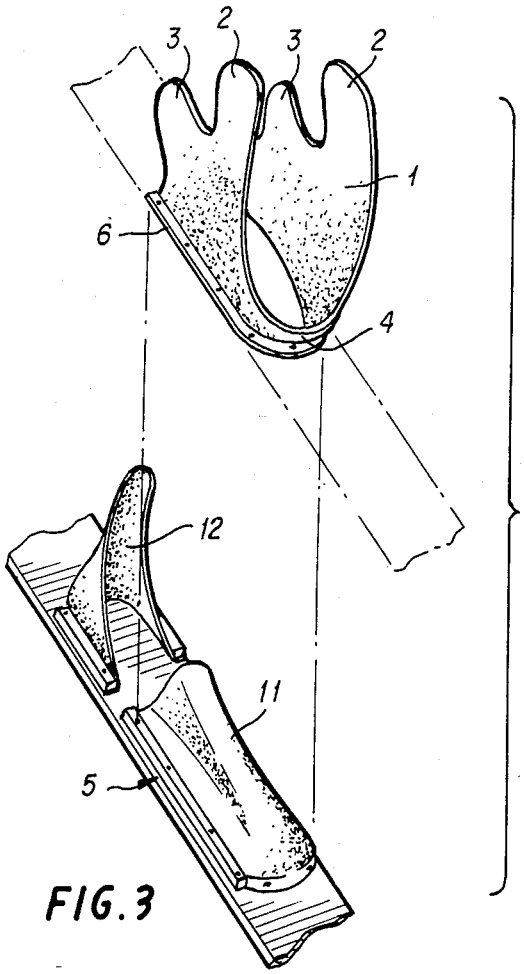
FIG. 3 is a right lateral, rearward and downward view of the instant invention separated from the ski but vertically aligned with the ordinary ski and its ordinary bindings.
Figure 4:
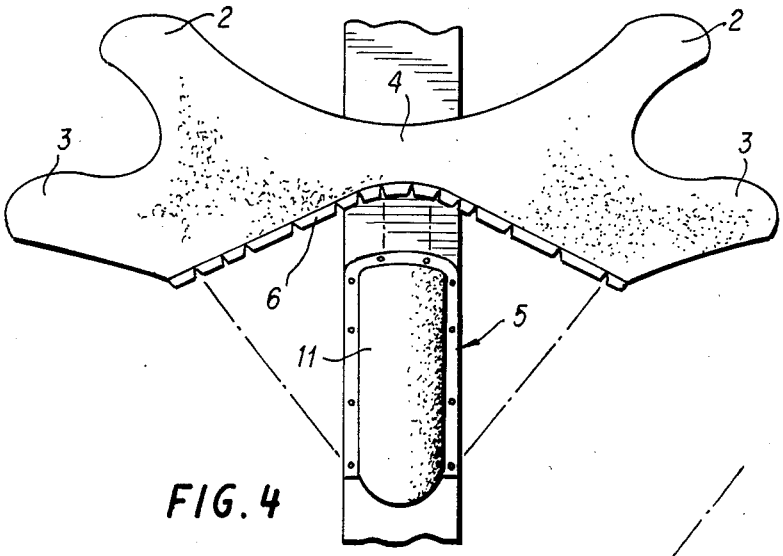
FIG. 4 is a flattened view of the instant invention with its sides spread out laterally and with its attachement points connected by by fine dashed lines to the corresponding attachment points in the ordinary ski.

This device is a paired (one for each leg) knee-contoured shell, made of firm, moderately tense and tear-resistant plastic sheeting material such as heat-vacuum or injection-molded 3/16" to ¼" polyethylene or polypropylene, shell that contours the kneeling knee (FIG. 1, numeral 1) in the following form: In a single piece, continuous sheet, medially and laterally to the knee, the device extends from the front of the patella bone area to the lower ⅓ to ½ of the sides of the thigh with lateral and vertical thigh extensions or "wings" (numeral 2), extending also rearward to cover the sides of the upper ⅓ to ½ of the calf with rear calf "wings" (numeral 3). Both medial and lateral thigh and calf wings are connected as continuous sheet with each other just in front of the user's patella bone, by a narrow istmus or band (numeral 4) that contours the said front of the patella area. The actual shape of this connecting band 4 is displayed three dimensionally in FIGS. 1 and 3 and flattened out in FIG. 4.

The device 1 therefore consist of two identical sections, approximately mirror of one another, one lateral and one medial and each one with a thigh wing and with a calf wing, both medial and lateral sections connected in a one piece continuous fashion with each other by a narrow band that contours the front of the user's patella bone.

Figure 2:
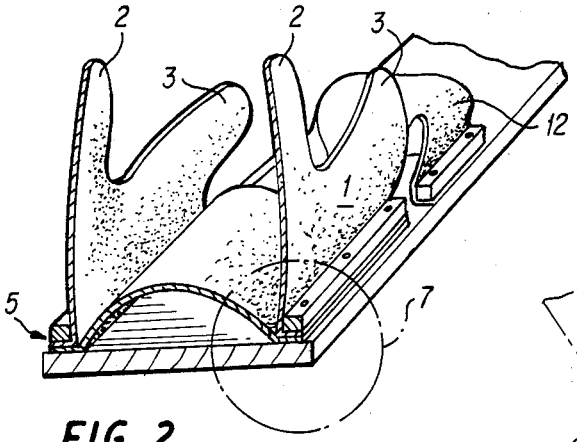
FIG. 2 is a left lateral rearward view of the cross-sectioned instant invention of FIG. 1 sectioned by the plane A—A.

The device 1 is attached to the periphery of an ordinary water ski front binding piece (numeral 5) via an out-turned attachment lip that forms the free bottom edge of the instant invention. This attachement lip is identified in FIGS. 3 and 4 by the numeral 6. This attachment lip 6 is held in position by the same screws that hold the ordinary front binding piece already existing in the ski, being the attachment lip of the described knee binding directly positioned over the attachment lip of the said ordinary binding and both lips ssecured and covered by the ordinarily used attachment rod that holds said lip(s) as a bite agaist the upper surface of the water ski. An ad-hoc enlargement of the attachment sequence of ski-foot binding-knee binding-holding rod is identified in FIG. 2 by the circle numbered 7.

Figure 1:
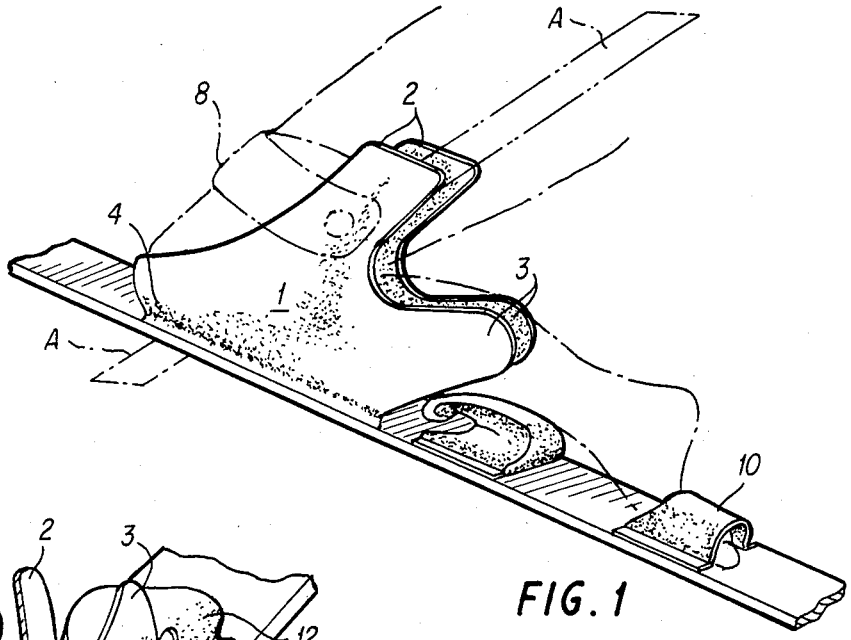
FIG. 1 Shows the instant device left lateral perspective view, binding the user's knee area. The ski and part of an ordinary binding is also shown.

The device 1 as in FIG. 1, as it leaves open the front of the user's thigh, is provided with an adjustable elastic strap 8, permanently attached to one of the vertical thigh wings, and bridgiing over the front of the thigh, movably and adjustably attached to the corresponding site on the opposite vertical thigh wing by means such as Velcro ®, hooks buckles or snaps.

The device 1 in its two main sections (one lateral, one medial) and in its continuous connecting band is provided with soft and rounded edges to prevent harm to the naked skin of the user. This said device 1, though made of moderately tense, firm and tear-resistant plastic to embrace the user's knee, lower thigh and upper calf, may also be coated, in its inner surface and its all-around free edges with a rubberized coating to make even less likely any harm to the naked skin of the user as he/she skis through rough waters (thus having some friction between the skin and the binding) or in a tumble. Conversely, the whole tense and firm sheeting plastic that forms the described instant invention can be manufactured of heavy gauge, semi-rigid synthetic rubber material (as used in the ordinary water ski bindings, or even more firm and rigid), in which case, no additional soft inner cushion or coating is needed.

Figure 5:
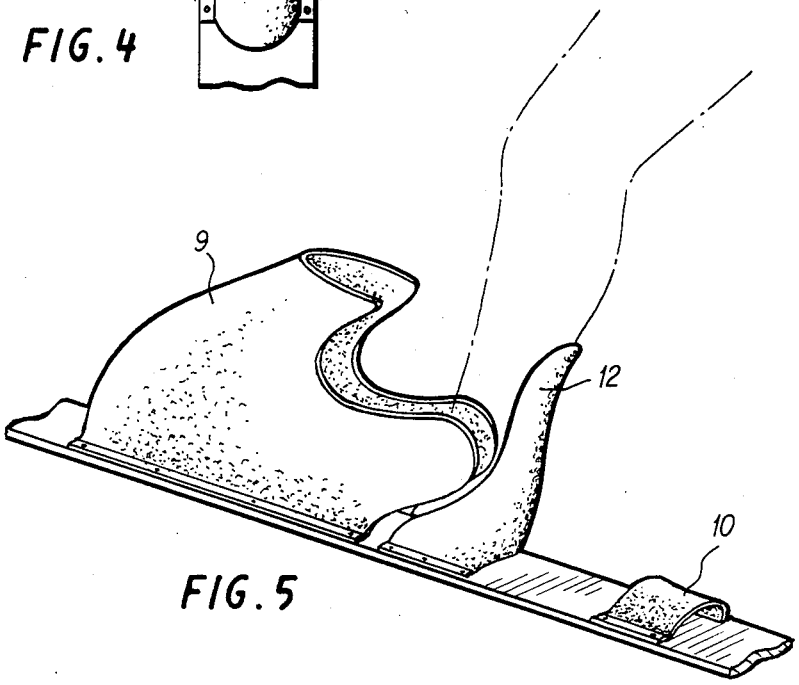
FIG. 5 is a left lateral perspective view of the instant invention in its front enclosed version. The user's leg, drawn in dashed lines is in the erect position and held to the ski by its ordinary bindings.
Figure 6:
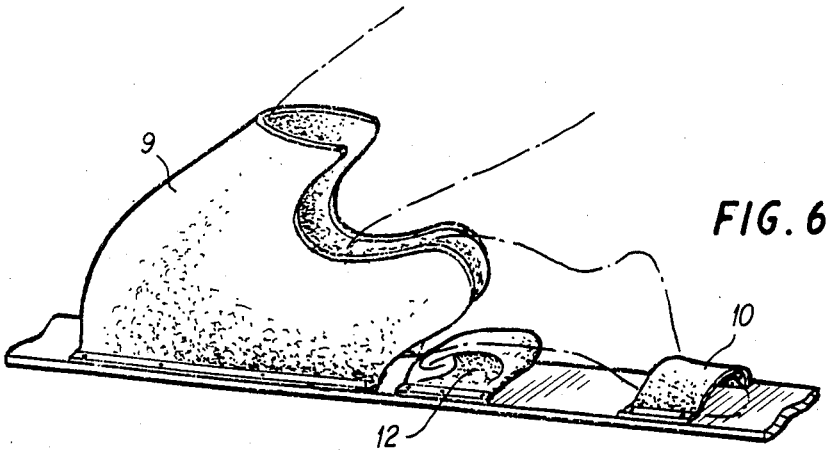
FIG. 6 is a left lateral perspective view of the instant invention in its front enclosed version as per FIG. 5, drawn here with the user (dashed lines) in the kneeling position, held in place by the invented device.

The instant invention of FIGS. 1, 2, 3 and 4 can be manufactured in the alternate form of FIGS. 5 and 6. The instant device of the latter two FIGS. 5 and 6 is esentially the same as that already described to this point, being the distinguishing quality of the alternate form of FIGS. 5 and 6 the full enclosure of the one piece instant invention in a continuous sheet over the front of the thigh as shown in the front contour identified by the numeral 9 in both said figures. Obviously this alternate knee binding is more rigid than the device of FIG. 1 and it does not allow much change in the kneeling angle of the thigh (obviously the elastic strap 8 has no place here), but it offers extra torque and control of the ski, requires no strap adjustment, has a very easy entry/-release and it may be ideal for the young and the beginner.

The rubberized transverse band 10 to hold the foot in the kneeling position is widely available and not part of this invention. The front and heel pieces of the ordinary foot binding (11 and 12 respectively), are not part of this invention either. Both are tucked under the user's leg when kneeling.

I claim:

1. A water ski and knee binding assembly for permitting a skier to water ski while assuming a kneeling position comprising in combination:

a water ski;

a resilient front binding secured to the top of the water ski for receiving the front portion of a skier's foot, said front binding having side edges secured to the top of the water ski, a front transverse edge secured to the top of the water ski, and a rear edge spaced above the top of the water ski to form an opening therebetween;

a resilient heel binding secured to the top of the wter ski at a location aft of said front binding, said heel binding having a curved portion for receiving the heel of a skier's foot and a vertically extending poriton for supporting the ankle of the skier;

a resilient band secured transversely across the top of the water ski at a location aft of said heel binding, said band having side edges secured to said water ski and having front and rear edges spaced above the water ski to form a through passage therebetween; and a knee binding for receiving the knee of a skier while in a kneeling position, said knee binding being in the form of a continuous sheet of flexible semi-rigid material, means for securing the bottom edge of the knee binding to the front and side edges of said front binding, said knee binding having a front portion for engaging the skier's knee, vertically extending side portions for covering one third to one half of the sides of the skier's thigh, and rearwardly extending side portions for covering one third to one half of the sides of the skier's calf;

wherein said front and heel binding are used together for securing the foot of a skier while in the standing position and said front and heel bindings are used as a kneeling pad when the skier is in the kneeling position.

2. The invention as defined in claim 1 wherein said vertically extending side portions extend above the height of said front portion and said knee binding includes an elastic strap secured to said vertically extending side portions and extending transversely therebetween for supporting the front of the skier's thigh.

3. The invention as defined in claim 1 wherein said front portion and said vertically extending side portions of said knee binding are of the same height above the ski.

* * * * *